US005445424A

United States Patent [19]

Binette

[11] Patent Number: 5,445,424

[45] Date of Patent: Aug. 29, 1995

[54] AUTOMATIC ARROW EXTRACTOR

[76] Inventor: Daniel Binette, 1953 chemin Curé Godbout, Rainville (Québec), Canada, J2N 2P9

[21] Appl. No.: 323,679

[22] Filed: Oct. 18, 1994

[51] Int. Cl.[6] ..... B66C 1/44

[52] U.S. Cl. ..... 294/1.1; 294/16; 294/25; 294/102.1

[58] Field of Search ..... 294/1.1, 15, 16, 86.31, 294/102.1, 25; 24/115 G, 115 M, 136 R; 29/270, 278, 283; 16/110 R, DIG. 12; 43/21.2, 25

[56] References Cited

U.S. PATENT DOCUMENTS

| | | | |
|---|---|---|---|
| 867,036 | 9/1907 | Hanford | 294/102.1 |
| 1,503,251 | 7/1924 | Schoof | 16/DIG. 12 |
| 3,171,178 | 3/1965 | Smith et al. | 294/104 X |
| 3,749,076 | 7/1973 | Suski et al. | 273/416 X |
| 3,776,586 | 12/1973 | Ahlgren et al. | 294/102.1 |
| 4,480,369 | 11/1984 | Sanders et al. | 29/270 |
| 5,015,023 | 5/1991 | Hall | 294/102.1 |
| 5,127,696 | 7/1992 | Awano et al. | 294/102.1 |
| 5,156,429 | 10/1992 | Adams | 294/25 |
| 5,228,610 | 7/1993 | Spence | 294/25 X |

*Primary Examiner*—Dean Kramer
*Attorney, Agent, or Firm*—Pierre Lespérance; Francois Martineau

[57] ABSTRACT

A device for extracting arrows from a target, the device having a frame defining a channel adapted to receive the shaft of an arrow to be extracted, gripping elements are moveable into and out of a gripping relationship with respect to an arrow shaft in the channel such that it may be securely gripped and pulled from the target. The frame is formed with a laterally extending handle of Z-shape which, when pulled to extract the arrow, does not produce bending and possible consequent breakage of the latter.

4 Claims, 1 Drawing Sheet

AUTOMATIC ARROW EXTRACTOR

FIELD OF THE INVENTION

The present invention relates to the sport of archery and, more particularly, it relates to a device for extracting arrows from a target.

BACKGROUND OF THE INVENTION

The sport of archery has recently started to become popular again and with its increased popularity, a number of different sectors of the population are participating in the sport. With the use of new bows such as the compound bow, a great deal of extra force is utilized and, accordingly, the arrows will frequently penetrate the target to an extent that it becomes difficult to remove the arrow, particularly if the archer does not have a great deal of strength.

OBJECTS OF THE INVENTION

It is therefore an object of the present invention to provide a device suitable for extracting arrows from a target.

It is a further object of the present invention to provide a device for extracting arrows from a target and which device is simple to use and permits easy removal of the arrow from the device after utilization.

SUMMARY OF THE INVENTION

In accordance with the objects of the invention, there is disclosed an arrow extractor for extracting arrows from a target, said arrow defining a cylindrical elongated shaft, said arrow extractor comprising:

a) a frame adapted to frictionnally engage said arrow shaft; and b) a handle member defining a main segment and a first and a second parallel segments, said segments being coplanar and being adapted to be in the plane of the longitudinal axis of said arrow shaft, said first and second parallel segments projecting integrally from the two extremities of said main segment and forming a large acute angle therewith; said first parallel segment being fixedly anchored to said frame and being adapted to be parallel to said arrow shaft.

According to one aspect of the present invention, there is provided a device for extracting arrows from a target, the device including a frame which has first and second spaced apart members associated therewith, the first and second spaced apart members defining a channel therebetween which is adapted to receive the shaft of an arrow to be gripped. First and second opposed gripping elements are operatively associated with the first and second members respectively, at least one of the gripping elements being moveable into and out of a gripping relationship with respect to an arrow shaft in the channel, the moveable element being adapted to move into a gripping relationship with the arrow when moved in a first direction, and out of a griping relationship with the arrow when moved in a second direction.

In greater detail, the device, as aforementioned, includes a frame which may be of many different configurations. The frame itself may range from a simple planar single piece of material having different configurations to a multi-dimensional type of frame. It suffices to say that it is well within the skill of those knowledgeable in the art to construct such a frame and associated components as will be discussed hereinbelow.

Associated with the frame are first and second members which are in a spaced apart relationship to define therebetween a channel which is adapted to receive the shaft of the arrow to be removed. The spaced apart members may be an integral part of the frame or be formed to be a separate portion attached to the frame. The spaced apart members may be parallel or in the embodiments to be described hereinbelow, the spaced apart members define a trapezoidally shaped channel for reasons which will become apparent from the detailed description.

Associated with each of the channel defining members is a gripping element which is adapted to function in a cooperative manner to grip the shaft of an arrow placed therebetween. As previously mentioned, at least one of the gripping elements is moveable into and out of a gripping relationship with the arrow shaft such that the device may be moved in a first direction to move the gripping element(s) towards a non-gripping position and permit the entry of the shaft therebetween. Subsequently, movement of the device in a second opposite direction will cause the gripping element to tighten about the shaft of the arrow and permit a force to be exerted thereon while the device is pulled in that direction to remove the arrow from the target.

In the embodiment of the invention, both of the gripping elements may be moveable although in certain embodiments, only one of the gripping elements needs to be moveable. Thus, if only one of the gripping elements is moveable, the other gripping element remains in a fixed position and indeed, in one embodiment, one of the channel defining members may function as the gripping element.

Each of the gripping elements preferably has associated therewith tensioning means such that they are continuously urged into a gripping relationship. Although not essential in the sense that the gripping elements could be moved manually, these biasing or tensioning means are preferably employed and can consist of a spring type of arrangement to bias the gripping elements towards the gripping position.

The frame may include a handle portion which may be formed integrally as part of the frame or in the alternative, may be a separate member attached to the frame. It suffices to say that there are many different configurations which could be utilized for a suitable handle portion.

The device may be formed of any suitable material and to this end, may be formed of a plastic or metallic material or combination thereof. It is preferable that at least the portion of the gripping elements contacting the arrow be formed of a material which will not damage the shaft of the arrow and to this end, certain plastics and/or rubber materials would be suitable.

To permit the device to easily enter into a gripping relationship, preferably each of the gripping elements is angled to permit entry of the shaft therebetween.

BRIEF DESCRIPTION OF THE DRAWINGS

Having thus generally described the invention, reference will be made to the accompanying drawings illustrating an embodiment thereof, in which.

DETAILED DESCRIPTION OF THE DRAWINGS

Figure 2:
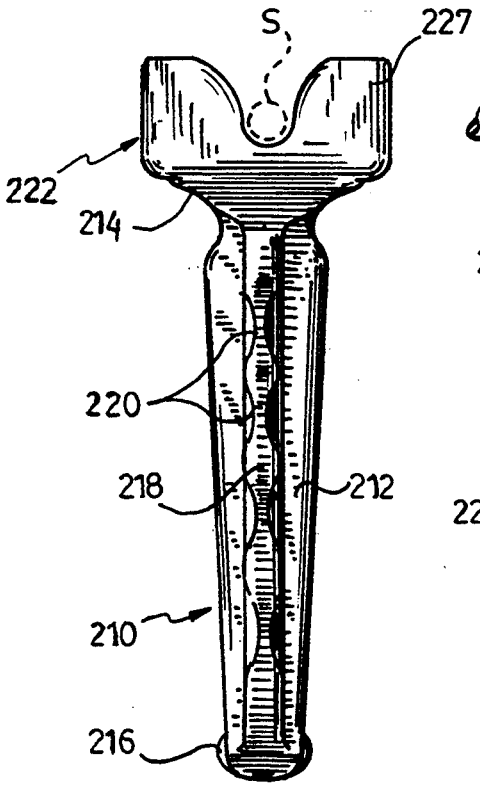
FIG. 2 is an end elevational view seen from the left hand side of FIG. 1.

Referring to the drawings in greater detail and by reference characters thereto, there is illustrated in FIGS. 1 to 5 a device 210 which has a vertical frame portion 212, a first horizontal frame portion 214 and a second horizontal frame portion 216. Frame portions 212, 214 and 216 are formed as a single unit and conveniently, in portion 216, there may be provided an aperture 256 for storing and/or carrying the device.

Extending from vertical frame portion 212 is a hand grip portion 218 which has recesses 220 formed therein adapted to receive the fingers of the holder. Attached to first horizontal frame portion 214 is a generally U-shaped member 222 having a base 224 with opposed side walls 226 and 228. Member 222 also includes opposed end walls 227 and 229. As may be seen in FIGS. 2 and 4, end walls 227 and 229 have a centrally located channel formed therein to receive the shaft of an arrow.

Extending between end walls 227 and 229 are a pair of shafts 237, 237'. Mounted on shafts 237, 237' are a pair of gripping elements 236 and 240 respectively. As may be seen, gripping elements 236 and 240 are slidable along the shafts and are biased towards one end by means of springs 254 and 254' respectively.

In operation, the device is placed against the shaft S of the arrow, with the arrow contacting the front or left hand side of the gripping element bodies 236 and 240, and associated gripping surfaces. The device is slid forward along the shaft, maintaining pressure thereon such that the gripping element bodies 236 and 240 are forced rearwardly, permitting shaft S to enter between the gripping surfaces. Subsequently, after shaft S has entered between the gripping elements 236 and 240, a rearward force is exerted as indicated by arrow 58 in FIG. 1. Due to the trapezoidal configuration of the side walls 226 and 228, the gripping elements 236 and 240 securely grip the shaft S, and the arrow may then be pulled from the target.

Figure 3:
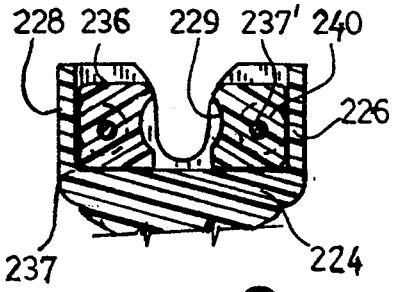
FIG. 3 is a sectional view taken along lines 3—3 of FIG. 1.
Figure 4:
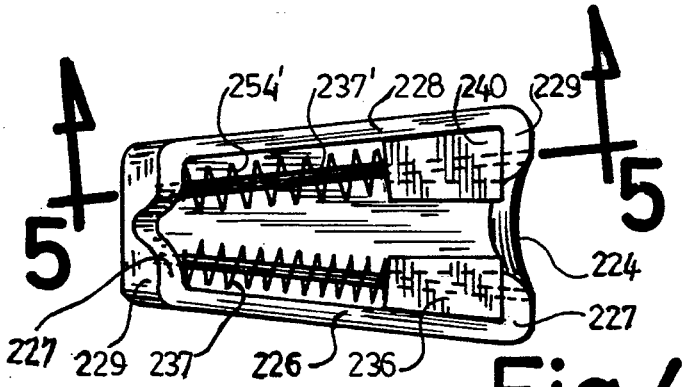
FIG. 4 is a top plan view thereof.
Figure 5:
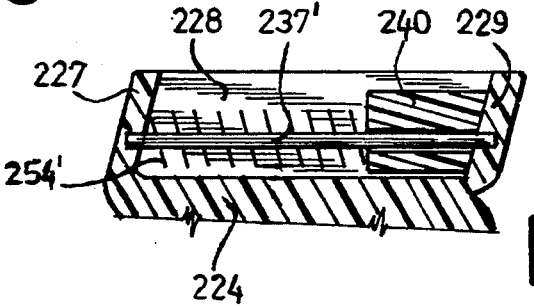
FIG. 5 is a sectional view taken along the lines 5—5 of FIG. 4.

It is important to note that the gripping surfaces of the gripping elements 236 and 240 are, as suggested in FIGS. 3 and 5, preferably made from an elastomeric material, such as rubber. Indeed, gripping surfaces have to be elastically deformable to allow the arrow shaft S to be inserted through their upper flanges which protrude inwardly from gripping members 236 and 240, respectively. Also, the material of these gripping members must be soft enough not to damage the arrow shaft S once the latter is inserted inside the channel for extracting the arrow, since the transversal pressure of gripping members 236, 240 on the arrow shaft S will be considerable. Finally, these gripping surfaces must have a good friction coefficient, for two reasons: firstly, the arrow shaft S must not slide between gripping members 236, 240 when the user pulls on the extractor to retrieve the arrow; secondly, to insert the arrow shaft S between gripping members 236, 240, the user must position the shaft S on the protruding flanges of these gripping surfaces and then combine a transversal pressure on shaft S to an axial translation therealong (arrow 58 in FIG. 1) to separate gripping members 236, 240 by divergently sliding them towards the rear end of the extractor; the arrow then elastically deforms the protruding flanges of these gripping surfaces and is inserted in the channel between gripping members 236, 240.

Figure 1:
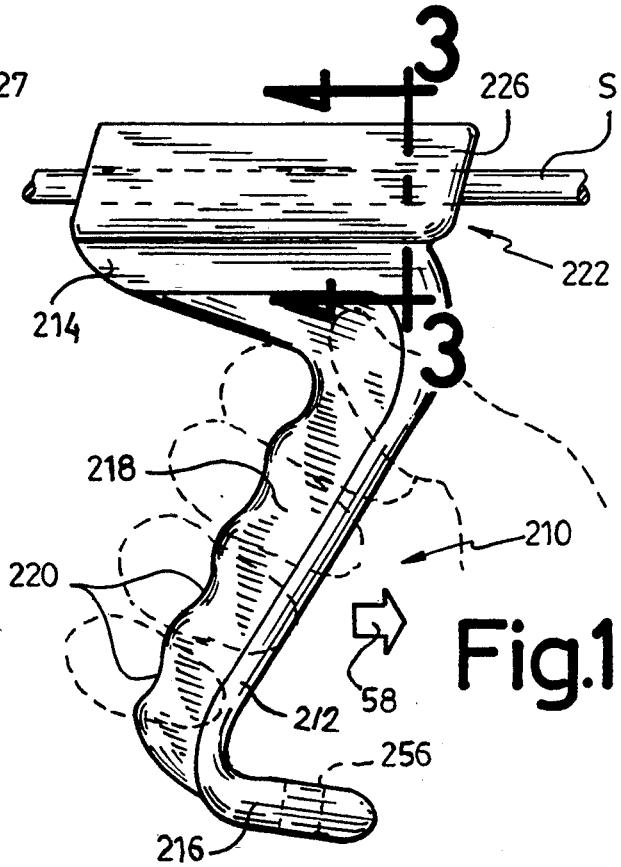
FIG. 1 is a side elevational view of a further embodiment of the gripping device.

FIG. 1 shows that vertical frame portion or segment 212 and first horizontal frame portion or segment 214 form a large acute angle, this angle consequently being formed also between vertical frame portion 212 and second horizontal frame portion or segment 216 (since first and second horizontal frame portions 214, 216 are approximately parallel). Grip portion 218 is fixedly supported by vertical frame portion 212 and is thus parallel thereto, and its upper portion is fixedly anchored to first horizontal frame portion 214 and thus allows the user's hand to more comfortably bear thereon. For greater convenience, the first and second horizontal frame portions 214, 216—vertical frame portion 212—grip portion 218 assembly will be referenced to as "handle member".

The angularity of vertical frame portion 212 is highly desirable because, once the arrow shaft is already inserted in the channel of U-shaped member 222, the user will produce a torque on the handle member. Indeed, by perpendicularly bearing with his hand upon both horizontal frame portions 214, 216, the user induces a moment around an axis positioned near the lower end of the handle member and perpendicular to the vertical plane thereof. This moment will result in a force being applied to U-shaped member 222 (and frictionnally transmitted to the shaft of the arrow), this force being tangential to the moment on the handle. Moreover, the angularity of vertical frame portion 212 itself will contribute to produce this torque, since the force applied on the handle is likely to be perpendicular to its longitudinal axis.

This means that, when the arrow shaft is to be retrieved, not only does the user apply a translational force parallel to the arrow shaft by pulling on the arrow extractor, but also he adds to this translational force a force resulting from the torque produced by the rotational force applied on the handle member, this force having a tangential component which is also approximately parallel to the arrow shaft. The resulting force is consequently much greater since it is the sum of both forces.

Furthermore, the user's hand will be vertically supported by the second horizontal frame portion 216. He may indeed bear upon the second horizontal frame portion 216 as long as he rotates his wrist correspondingly to bear approximately equally on first horizontal portion 214: this way, the vertical components of the force induced by the torque will counterbalance one another, and only the desired horizontal component will remain. This will ease the job of extracting the arrow, for the user will have less to worry about bending and possibly breaking the arrow by rotating inadvertently the arrow extractor by applying a vertical force on the arrow shaft, than if he were using a handle perpendicular to the U-shaped member 222 of the extractor.

Also, since the handle member remains generally vertical, it is still easy for the user to transversely insert the arrow shaft in U-shaped member 222 by applying a vertical pressure on the handle member.

Thus, the user needs only to hold the handle member to extract the arrow from the target, he does not need to separate by hand the gripping members or any other element.

It is possible to use the arrow extractor anywhere around the arrow shaft. Therefore, grip member 218 has a constant cross-section to permit the hand to grab the handle member as suggested in FIG. 1 or up side down, i.e. with the index and thumb near second horizontal frame member 216. The cross-section of the handle member is also symetrical, relative to the vertical plane passing by frame members 212, 214, 216, to fit both right-handed and left-handed users.

It will be understood that the above described embodiment is for purposes of illustration only and that changes and modifications may be made thereto without departing from the spirit and scope of the invention.

I claim:

1. An arrow extractor for extracting arrows from a target, said arrow defining a cylindrical elongated shaft, said arrow extractor comprising:

a) a frame adapted to frictionally engage said arrow shaft; and b) a handle member defining a main segment and a first and a second parallel segments, said segments being coplanar and being adapted to intersect a plane extending through the longitudinal axis of said arrow shaft, said first and second parallel segments projecting integrally from the two extremities of said main segment and forming a large acute angle therewith;

said first parallel segment being fixedly anchored to said frame and being adapted to be parallel to said arrow shaft; wherein said frame defines:

a) a relatively flat base having an upper and lower surface, said first segment of said handle being fixedly anchored to said lower surface of said flat base;

b) two spaced apart wall member othogonally and fixedly anchored on said upper surface of said base, said wall members being angled with respect to each other and thus forming a convergent main channel;

c) two gripping elements positioned intermediate said wall members and movable in said main channel, said gripping elements defining inner surfaces facing one another, said inner surfaces having a groove so as to define an arcuately shaped channel adapted to receive an arrow shaft; and d) two adherent, elastically deformable and soft gripping surfaces, one of which is fixedly anchored to each of said grooves of said inner surfaces of said gripping elements, said gripping surfaces having upper flanges protruding at least inwardly, relative to said arcuately shaped channel, from said gripping elements;

said gripping elements being adapted to move in a first divergent direction along said wall members when said upper flanges of said gripping surfaces transversely bear on said shaft and when said frame is simultaneously axially translated therealong, so as to form an opening for said arrow shaft into said arcuately shaped channel, said gripping elements then being adapted to move into a convergent direction to come into a gripping relationship with said arrow shaft, said gripping surfaces axially and frictionally engaging said arrow shaft.

2. An arrow extractor as defined in claim 1, wherein a grip member is fixedly anchored along said main segment, said grip member being adapted to be gripped by the hand of the user of said arrow extractor.

3. An arrow extractor as defined in claim 1, further including biasing means adapted to bias said gripping elements in said convergent direction.

4. An arrow extractor as defined in claim 3, wherein said biasing means comprise a pair of springs, each spring having a first end attached to said frame and a second end attached to one of said gripping elements.

* * * * *